US005090606A

United States Patent [19]

Torii et al.

[11] Patent Number: 5,090,606

[45] Date of Patent: Feb. 25, 1992

[54] COMBUSTION GAS POWERED FASTENER DRIVING TOOL

[75] Inventors: Takuji Torii, Ushiku; Hiromu Utsumi, Katsuta; Shinki Ohtsu, Ibaraki; Yo Kawakami, Mito; Teruo Suzuki, Hitachi; Yoshimitsu Kawasaki, Mito; Toshifumi Kubota, Katsuta; Yoshinori Ishizawa, Katsuta; Tsunehisa Terayama, Katsuta, all of Japan

[73] Assignee: Hitachi Koki Company, Limited, Japan

[21] Appl. No.: 603,659

[22] Filed: Oct. 26, 1990

[30] Foreign Application Priority Data

Oct. 27, 1989 [JP] Japan ..... 1-280883
Aug. 10, 1990 [JP] Japan ..... 2-212757

[51] Int. Cl.[5] ..... B25C 1/08

[52] U.S. Cl. ..... 227/10; 227/8; 123/46 SC

[58] Field of Search ..... 227/9, 10, 8; 173/134, 173/121, 13; 123/46 SC; 60/632, 633, 637

[56] References Cited

U.S. PATENT DOCUMENTS 4,403,722 9/1983 Nikolich ..... 227/8
4,483,473 11/1984 Wagdy ..... 227/8
4,483,474 11/1984 Nikolich ..... 227/10 X
4,522,162 6/1985 Nikolich ..... 123/46 SC
4,712,379 12/1987 Adams et al. ..... 60/633 X
4,773,581 9/1988 Ohtsu et al. ..... 227/10

*Primary Examiner*—Frank T. Yost
*Assistant Examiner*—C. Dexter
*Attorney, Agent, or Firm*—Lowe, Price, LeBlanc & Becker

[57] ABSTRACT

A combustion gas powered fastener driving tool includes inlet and outlet openings through which the combustion gases are discharged from a combustion chamber. These openings are located above the uppermost driving position (top dead center) of a slidable piston, so that an air and fuel mixture is fully trapped in the combustion chamber until after it is combusted. Since an outflow of the unburnt air and fuel mixture is completely prevented, the rate of fuel consumption of the fastener driving tool is high and there is no danger of accidental explosion of unburned fuel even when the fastener driving tool is used in a badly ventilated working place or site. An electric fan for forcing fresh air into the combustion chamber is disposed outside the cylinder and isolated from high temperatures. The fan is durable in structure and reliable in operation.

17 Claims, 11 Drawing Sheets

COMBUSTION GAS POWERED FASTENER DRIVING TOOL

BACKGROUND OF THE INVENTION

1. Field of the Invention

The present invention relates generally to combustion gas powered fastener driving tools, and more particularly to a fastener driving tool such as a tacker or nailer having a movable piston powered by the pressure of combustion of a mixture of air and fuel consisting of liquefied gas such as liquefied butane gas.

2. Description of the Prior Art

One known combustion gas powered fastener driving tool is disclosed in U.S. Pat. No. 4,403,722. The disclosed fastener driving tool includes ports located between the top and bottom dead centers of a movable piston for permitting combustion gases to flow from a combustion chamber to the outside of tool after the piston sliding within a cylinder moves past the ports under the pressure of combustion of an air and fuel mixture within the combustion chamber. Combustion of the air and fuel mixture proceeds downwardly from an upper side of the top dead center adjacent to a spark plug, toward an upper end face of the piston. This means that combustion of a part of the air and fuel mixture existing in the vicinity of the spark plug raises the pressure in the combustion chamber which will start moving the piston downwardly. In this instance, it is likely that a part of the air and fuel mixture located adjacent the upper end face of the piston follows the downward movement of the piston and is withdrawn from the ports to the atmosphere before it is combusted. The rate of fuel consumption of the conventional fastener driving tool is, therefore, relatively low. When the driving tool is used in a badly ventilated working place or site, the unburnt fuel gases withdrawn from the tool gradually accumulate in the working site and may explode if ignited.

The conventional fastener driving tool includes an electric fan disposed within the combustion chamber for thoroughly mixing air and fuel. With this arrangement, the fan is heated at high temperatures when the fastener driving tool is used continuously. These high temperatures tend to deteriorate the durability of various components of the electric fan, resulting in a malfunction of the electric fan.

SUMMARY OF THE INVENTION

With the foregoing drawbacks of the prior art in view, it is an object of the present invention to provide a combustion gas powered fastener driving tool which is operative without involving an outflow of unburnt fuel gases and, therefore, has a high rate of fuel consumption and is free from a danger of accidental explosion of the unburnt fuel gases even when the tool is used in a badly ventilated working site, and is durable in structure and reliable in operation.

In brief, a combustion gas powered fastener driving tool of the present invention includes inlet and outlet openings through which the combustion gases are discharged from a combustion chamber. These openings are located above the uppermost driving position (top dead center) of a slidable piston, so that an air and fuel mixture is fully trapped in the combustion chamber until after it is combusted. Since an outflow of the unburnt air and fuel mixture is completely prevented, the rate of fuel consumption of the fastener driving tool is high and there is no danger of accidental explosion of unburned fuel even when the fastener driving tool is used in a badly ventilated working place or site. An electric fan for forcing fresh air into the combustion chamber is disposed outside the cylinder and isolated from high temperatures. The fan is, therefore, durable in construction and reliable in operation. A turbulence plate having a single central orifice is disposed in the combustion chamber for producing turbulence in the combustion chamber.

According to the present invention, there is provided a combustion gas powered fastener driving tool, which comprises a cylinder; a cylinder head sealingly engageable with an upper end of the cylinder; a piston slidably disposed within the cylinder and reciprocatingly movable between an uppermost driving position and a lowermost driven position, the cylinder, the cylinder head and the piston defining a combustion chamber; a fastener driver attached to the piston; at least one fuel injection nozzle disposed within the combustion chamber for injecting fuel into the combustion chamber where the fuel and air are mixed together; a spark plug mounted on the cylinder head and disposed within the combustion chamber for igniting a fuel and air mixture to move the piston through a driving stroke from the driving position to the driven position, thereby forcing the fastener driver to drive a fastener into a workpiece; the cylinder having inlet and outlet openings and being reciprocatingly movable toward and away from the cylinder head to close off the inlet and outlet openings to seal the combustion chamber during combustion and open the inlet and outlet openings to permit scavenging of the combustion chamber and return of the piston after the driving stroke of the piston, the inlet and outlet openings being disposed above the piston when the piston is disposed in its uppermost driving position; and a fan disposed outside the cylinder for causing fresh air to flow from the inlet opening into the combustion chamber and simultaneously to discharge combustion gases from the combustion chamber to the atmosphere through the discharge opening.

The above and other objects, features and advantages of the present invention will become more apparent from the following description when making reference to the detailed description and the accompanying sheets of drawings in which a preferred structural embodiment incorporating the principles of the present invention is shown by way of illustrative example.

BRIEF DESCRIPTION OF THE DRAWINGS

FIG. 3(*b*) is a cross-sectional view of the turbulence plate;

DETAILED DESCRIPTION OF THE PREFERRED EMBODIMENTS

Figure 1:
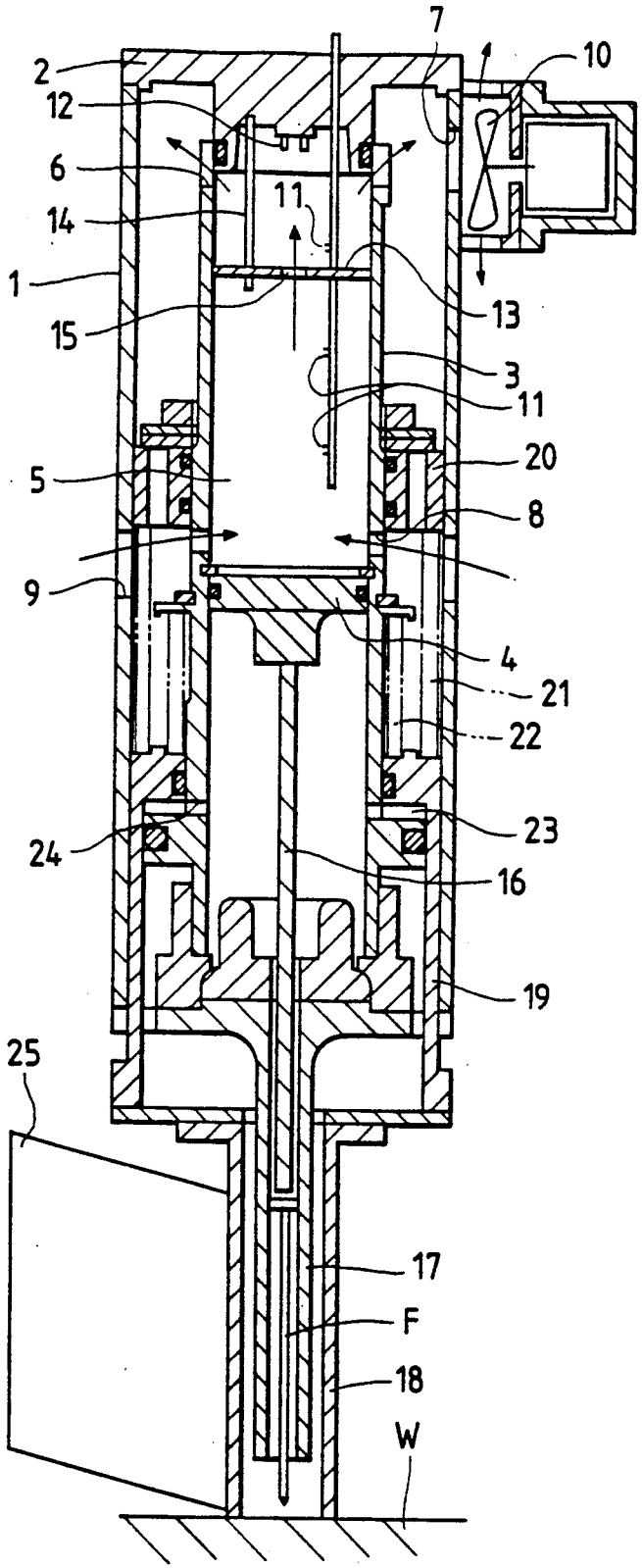
FIG. 1 is a cross-sectional view of a combustion gas powered fastener driving tool according to a first embodiment of the present invention, illustrating the relative position of the principal components as they are in the scavenging and standby position.

Referring now to the drawings wherein like reference characters designate like or corresponding parts throughout the several views, FIG. 1 shows a combustion gas powered fastener driving tool or nailer according to a first embodiment of the present invention. In this figure, the fastener driving tool is shown with parts in the scavenging and standby position.

The fastener driving tool includes a tubular housing 1, a cylinder head 2 connected to an upper end of the housing 1, a slidable cylinder 3 disposed in, and extend coaxially with, the housing 1, and a disc piston 4 slidably disposed within the cylinder 3. The cylinder head 2, the cylinder 3 and the piston 4 define a combustion chamber 5 in which air and fuel are mixed. The cylinder 3 is movable in an axial direction so that an upper end of the cylinder 3 is brought into and out of sealing contact with the cylinder head 2 for closing and opening the combustion chamber 5. The cylinder 3 has upper openings 6 extending from the upper end thereof and communicating with an air outlet hole 7 in the housing 1, and lower openings 8 located in a level immediately above the top dead center of the piston 4 and communicating with air inlet holes 9 in the housing 1. An electric fan 10 is disposed on the housing 1 in front of the air outlet hole 7 for forcing air to flow along a path extending successively through the air inlet holes 9, through the lower holes 8, through the combustion chamber 5, through the upper holes 6 and through the air outlet hole 7. With this airflow, combustion gases are discharged from the combustion chamber 5, while at the same time, fresh air used for a next cycle of combustion is supplied into the combustion chamber 5. In the drawings, the direction of combustion gases and air is indicated by arrows.

Figure 5:
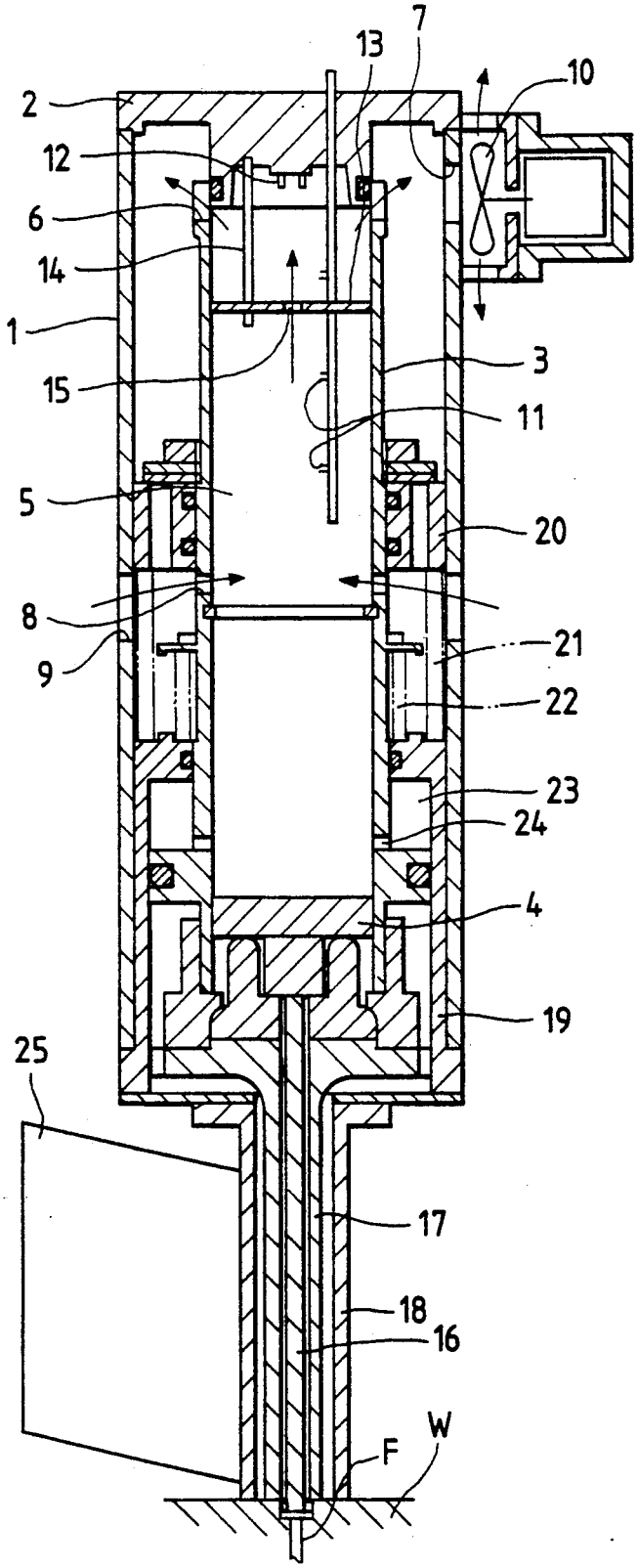
FIG. 5 is a cross-sectional view of the fastener driving tool of FIG. 1 illustrating the relative position of the principal components before the piston is returned to the top dead center due to vacuum created in the combustion chamber.

At least one fuel injection nozzle 11 (three in the illustrated embodiment) is disposed within the combustion chamber 5 for injecting fuel into the combustion chamber 5. The fuel consists of liquefied gas such as liquefied butane gas. The fuel injected into the combustion chamber 5 is mixed with air which has been drawn into the combustion chamber 5 by the electric fan 10. A spark plug 12 mounted on the cylinder head 2 is disposed within the combustion chamber 5 for firing an air and fuel mixture within the combustion chamber 5 when a trigger switch (not shown) of the tool is activated. Upon combustion, the pressure in the combustion chamber 5 rises, thereby lowering the piston 4 from the upper driving position (FIG. 1) toward the lower driven position (FIG. 5). The downward movement of the piston 4 defines a driving stroke of the piston 4, while the upward movement of the piston 4 defines a return stroke of the piston 4.

Figure 3A:
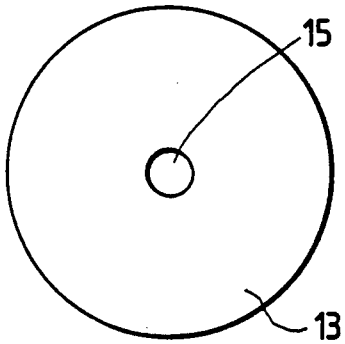
FIG. 3(*a*) is a plan view of a circular turbulence plate or disc incorporated in the fastener driving tool of FIG. 1.
Figure 3B:
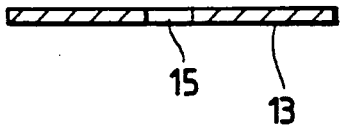

A turbulence device in the shape of a circular turbulence plate 13 is supported within the combustion chamber 5 by means of a bar 14 extending from the cylinder head 2. The turbulence plate 13 has an outside diameter substantially the same as the inside diameter of the cylinder 3 and also has a central aperture or orifice 15. As shown in FIGS. 3(*a*) and 3(*b*) the diameter of the orifice 15 is considerably smaller than the outside diameter of the turbulence plate 13.

The piston 4 carries a fastener driving rod or driver 16 for driving a fastener F into a workpiece W. The lower end of the fastener driver 16 fits within a tubular barrel 17 connected to the lower end of the housing 1. A slidable tubular guide 18 extends coaxially with the cylinder 3 and is connected to a lower end of a ring member 19 slidably fitted between the housing 1 and the cylinder 3. The guide 18 is adapted to engage the workpiece W before the barrel 17 and the fastener driver 16. A seal ring 20 is slidably fitted over the cylinder 3 and fixed to an inner peripheral wall of the housing 1 for closing the lower openings 8 of the cylinder 3 when the cylinder 3 is moved upwardly relative to the housing 1, as described later. An outer compression coil spring 21 is disposed along the inner peripheral wall of the housing 1 and acts between the seal ring 20 and the ring member 19 for urging the latter downward. An inner compression coil spring 22 is disposed around the cylinder 3 and acts between an integral flange of the cylinder 3 and the ring member 19 for urging them away from one another. The ring member 19 and the cylinder 3 define an annular pressure chamber 23 which communicates with the combustion chamber 5 via communicating holes 24 in the cylinder 3 when the piston 4 is disposed in its lowermost driven position shown in FIG. 5. A magazine or feeder 25 is attached to the guide 18 for supplying fasteners F one at a time into the barrel 18 beneath the fastener driver 16, in timed relation to the reciprocating movement of the piston 4.

Figure 2:
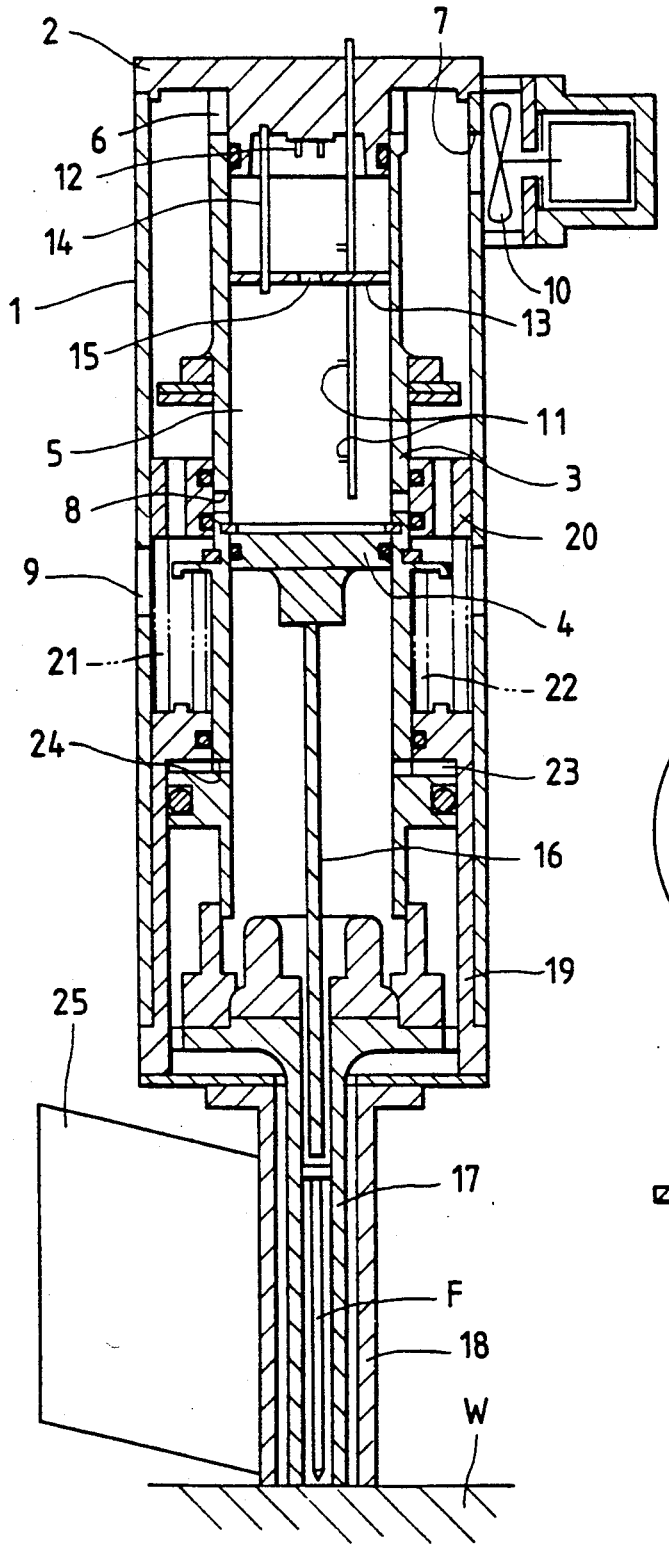
FIG. 2 is a cross-sectional view of the fastener driving tool of FIG. 1 illustrating the relative position of the principal components when the fastener driving tool is fired.

Operation of the fastener driving tool of the foregoing construction will follow. For purposes of illustration, operation begins with parts in the scavenging and standby position shown in FIG. 1. In this state, the piston 4 is disposed in its uppermost driving position (top dead center), and the interior of the combustion chamber 5 communicates with the atmosphere through the upper and lower openings 6, 8 in the cylinder 3 and through the air inlet and outlet holes 9, 7 in the housing 1. The electric fan 10 is activated so that fresh air is introduced into the combustion chamber 5 and combustion gases are moved from the combustion chamber 5 to the atmosphere. After the combustion chamber 5 is fully scavenged with the fresh air, the guide 18 is forced against the workpiece W by manually pushing or thrusting the tool forwardly toward the workpiece W, whereupon the ring member 19 is displaced upwardly against the force of the outer spring 21. This upward movement of the ring member 19 causes the inner spring 22 to resiliently lift the cylinder 3 With the result that the upper and lower openings 6, 8 are closed by the cylinder head 2 and the seal ring 20, respectively. Thus, the combustion chamber 5 is isolated from the atmosphere, as shown in FIG. 2. In this instance, the fresh air is trapped in the combustion chamber 5.

Then, fuel such as liquefied butane gas is injected via the fuel injection nozzles 11 into the combustion chamber 5 by means of a known suitable injection device (not shown). The fuel thus injected mixes with air to form an air and fuel mixture. Subsequently, the non-illustrated trigger switch is activated whereupon a spark occurs across the spark plug 12. This spark ignites or fires the air and fuel mixture remote from the piston 4. The air and fuel mixture thus fired or combusted in the vicinity of the spark plug 12 expands rapidly and thereby forces the unburnt air and fuel mixture toward the piston 4 via the orifice 15 of the turbulence plate 13. In this instance, since the diameter of the orifice 15 is considerably smaller than the inside diameter of the cylinder 3, the unburnt air and fuel mixture is contracted and subsequently expands rapidly, thereby creating great turbulent currents in the air and fuel mixture below the turbulence plate 13. With the turbulent currents thus created, combustion of the air and fuel mixture is promoted and hence completes for a short period of time with a low heat loss and at a high combustion pressure. Furthermore, since the orifice 15 is located centrally in the turbulence plate 13, as shown in FIGS. 3(*a*) and (3*b*), the combustion proceeds from a central region of the combustion chamber 5 toward the peripheral wall of the cylinder 3. The cylinder 3 is, therefore, exposed to high temperatures only for a short period of time. Thus, a heat loss resulting from heat transfer from the combustion gas to the cylinder 3 can be reduced and a high combustion pressure is obtained.

Figure 4:
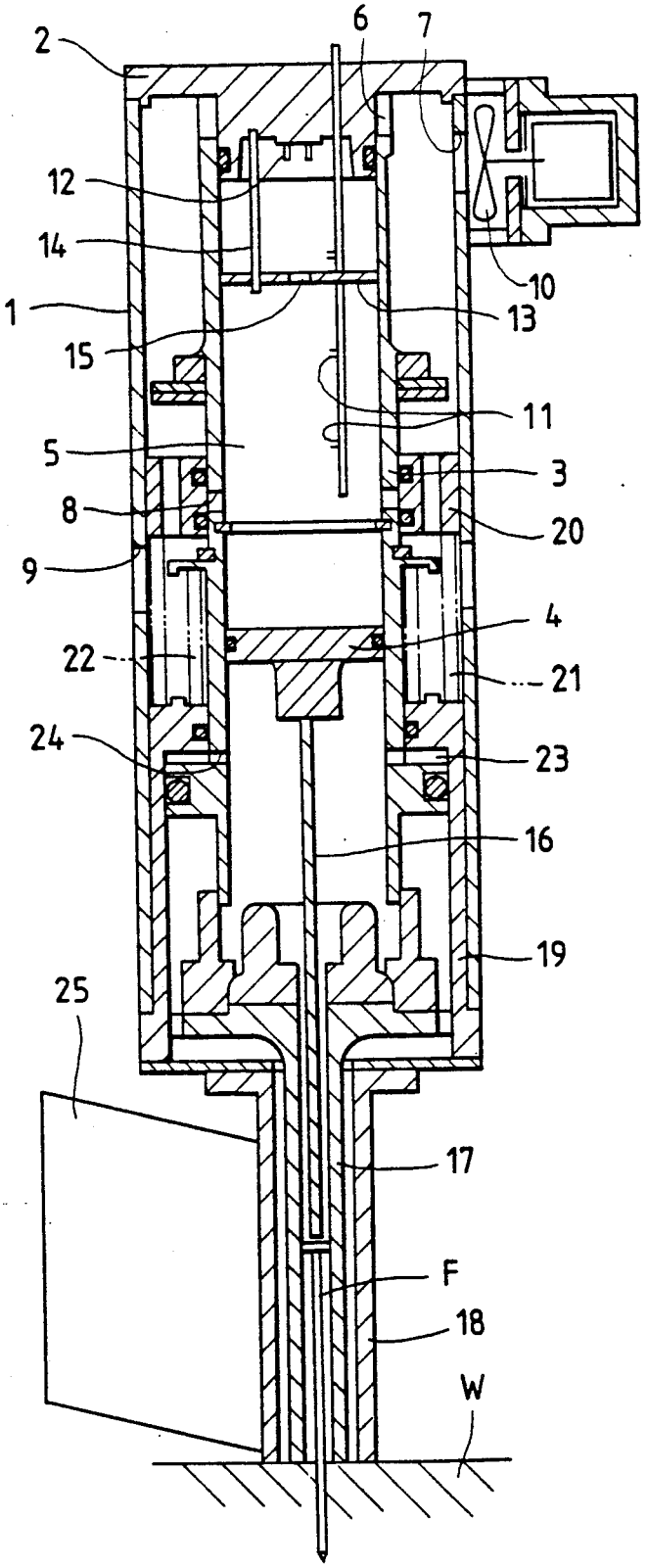
FIG. 4 is a cross-sectional view of the fastener driving tool of FIG. 1 illustrating the relative position of the principal components during a fastener driving operation.

As the air and fuel mixture burns, the temperature and the pressure in the combustion chamber 5 rise so that the piston 4 is moved downward through a driving stroke. The fastener driver 16 moves together with the piston 4. As the fastener driver 16 moves toward the workpiece W, the fastener driver 16 encounters a fastener F and then drives the fastener F into the workpiece W, as shown in FIG. 4.

When the driving stroke of the piston 4 is completed, the piston 4 is disposed in its lowermost driven position (bottom dead center) where piston 4 is located below the communicating holes 24. The combustion chamber 5 now communicates via the communicating holes 24 with the pressure chamber 23 so that the high pressure combustion gases are permitted to flow into the pressure chamber 23 and force the cylinder 3 downwardly against the force of the inner spring 22, as shown in FIG. 5. The high pressure combustion gases do not yield the outer spring 21 because the spring force of the outer spring 21 is greater than that of the inner spring 22. The downward movement of the cylinder 3 opens the upper and lower openings 6, 8, thereby communicating the interior of the combustion chamber 5 with the atmosphere. The high pressure combustion gases move from rh combustion chamber 5 to the atmosphere via the upper and lower openings 6, 8 and the air inlet and outlet openings 9, 7. Then, fresh air is drawn again by the electric fan 10 into the combustion chamber 5 through the air inlet holes 9 of the housing 1 and through the lower openings 8 of the cylinder 3. When the high pressure combustion chamber 5 is fully scavenged with the fresh air, the combustion chamber 5 is kept at the atmospheric pressure. This permits the inner spring 22 to extend and restore its original shape, so that the cylinder 3 is moved upwardly to a position substantially the same as the position shown in FIG. 4. In this state, the temperature in the combustion chamber 5 is higher than the room temperature. As the time goes on, the combustion chamber 5 is gradually cooled and when the combustion chamber 15 is cooled below 100° C., condensation of vapor occurs within the combustion chamber 5. With this vapor condensation, the pressure in the combustion chamber 5 drops below the atmospheric pressure. Since the underside of the piston 4 is exposed to the atmospheric pressure, the piston 4 is moved from the lowermost driven position to the uppermost driving position. Thereafter, the manual forward thrusting force on the tool is released so that the thrust on the guide 18 is released whereupon the fastener driving tool returns to the condition shown in FIG. 1. Thus, a fastener driving cycle of the tool is completed.

As described above, the upper and lower openings 6, 8 through which the combustion gases are discharged from the combustion chamber 5 are located above the uppermost driving position (top dead center) of the piston 4, the air and fuel mixture is fully trapped in the combustion chamber until after it is combusted. Since an outflow of the unburnt air and fuel mixture is completely prevented, the rate of fuel consumption of this fastener driving tool is high and there is no danger of accidental explosion of unburned fuel even when the fastener driving tool is used in a badly ventilated working place or site. The electric fan 10 disposed outside the cylinder is isolated from high temperatures and hence is durable in construction and reliable in operation. The turbulence plate 13 having a single central orifice 15 is also durable and effective to reduce the time period during which the high temperature combustion gases contact the inner peripheral wall of the cylinder 3. With this turbulence plate 13, a high combustion pressure can be obtained.

Figure 6:
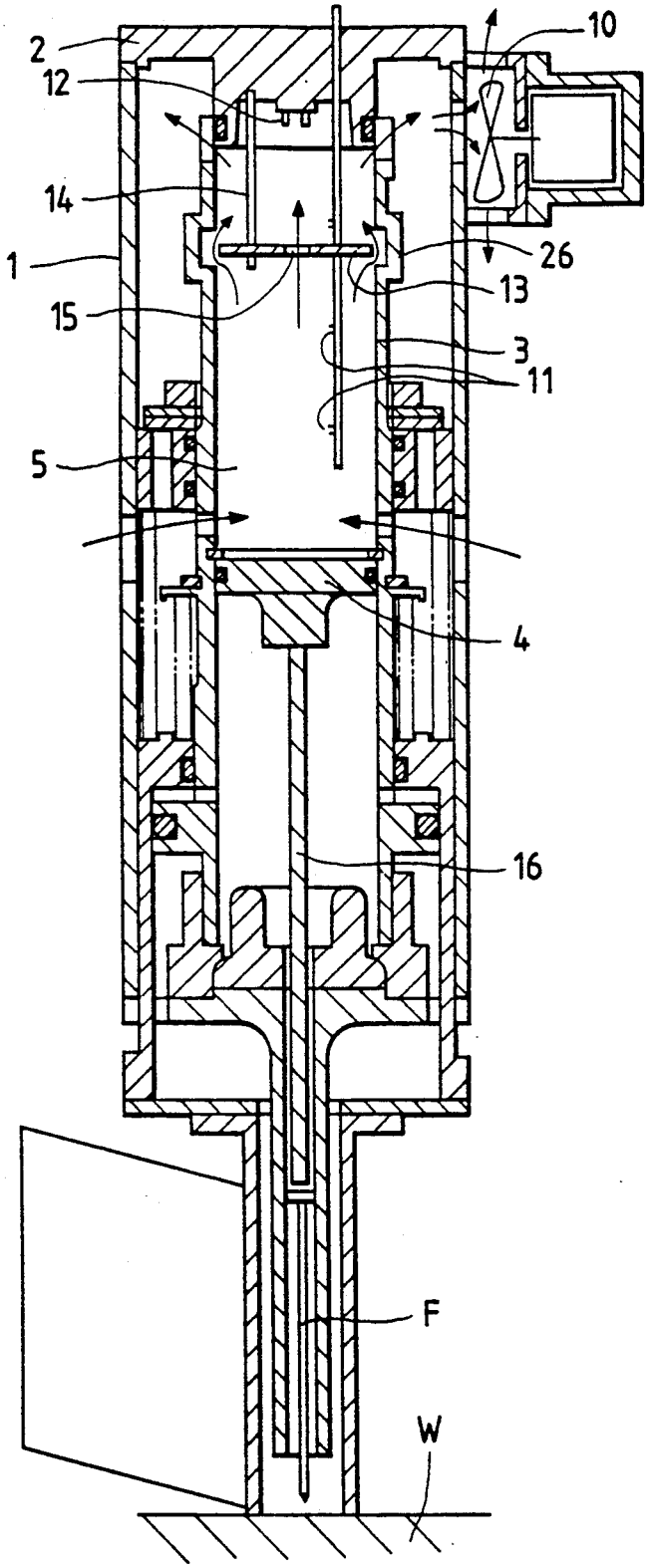
FIGS. 6 and 7 are cross-sectional views of a combustion gas powered fastener driving tool in different states, respectively, according to a second embodiment of this invention.
Figure 7:
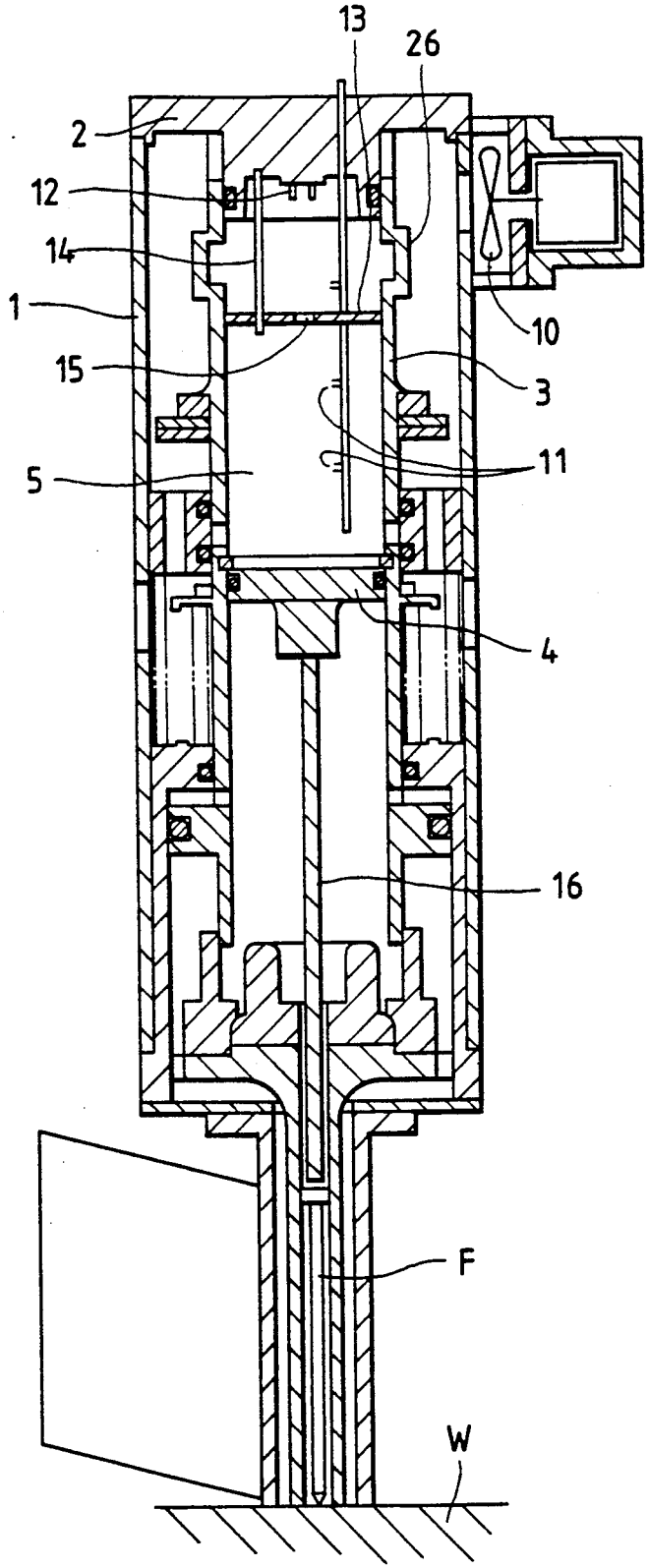

FIGS. 6 and 7 show a combustion gas powered fastener driving tool according to a second embodiment of this invention. This fastener driving tool is substantially the same as the fastener driving tool of the first embodiment shown in FIGS. 1 through 5 with the exception that the cylinder 3 includes a bulged circumferential portion 26. The bulged portion 26 is disposed relative to the circular turbulence plate 13 in such a manner that the bulged portion 26 and the turbulence plate 13 extend in a same plane when the fastener driving tool is in the standby and scavenging condition shown in FIG. 6, and the bulged portion 26 and the turbulence plate 13 extend in different planes when the fastener driving tool is in the operating or driving condition shown in FIG. 7. In the standby and scavenging condition, the combustion gases are permitted to flow not only through the orifice 15 but also through an annular space defined between the periphery of the turbulence plate 13 and the bulged circumferential portion 26 of the cylinder 3. The combustion gases are, therefore, discharged from the combustion chamber 5 rapidly. This enables the tool to perform a high speed repeated fastener driving operation. During the fastener driving operation, the bulged portion 26 is upwardly displaced from the turbulence plate 13 and hence turbulence plate 13 closely fits within the cylinder 3. Thus, the turbulence plate 13 effectively creates turbulent currents in the air and fuel mixture as the mixture is forced downwardly through the central orifice 15. The bulged circumferential portion 26 serves as a scavenging promoting means.

Figure 8:
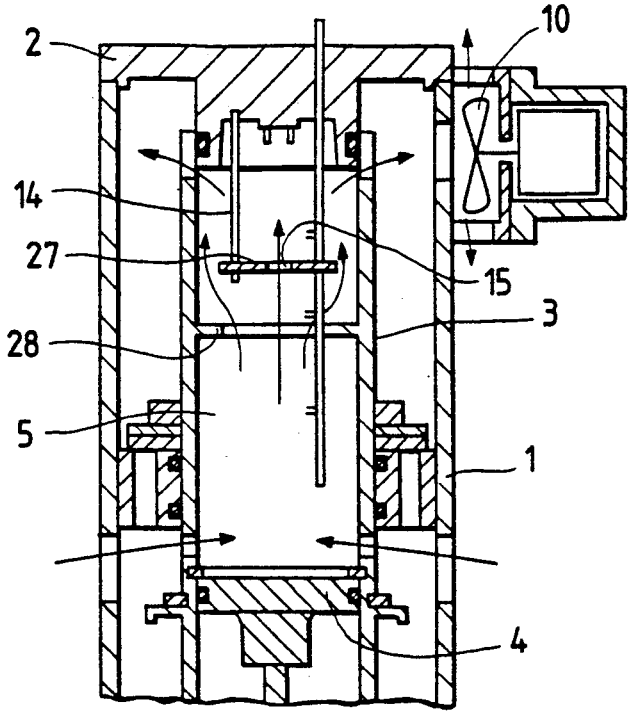
FIGS. 8 and 9 are fragmentary cross-sectional views of a combustion gas powered fastener driving tool in different states, respectively, according to a third embodiment of this invention.
Figure 9:
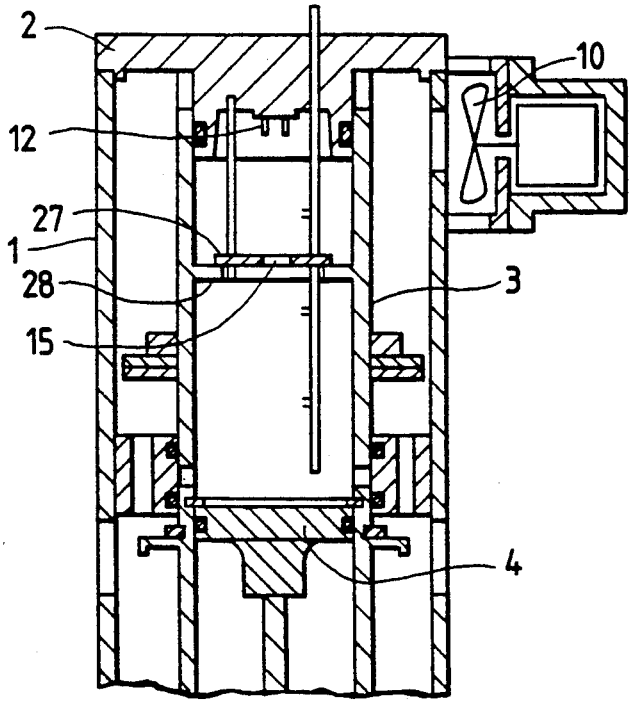

FIGS. 8 and 9 fragmentarily show a combustion gas powered fastener driving tool according to a third embodiment of this invention. This fastener driving tool differs from the fastener driving tool of the first embodiment shown in FIGS. 1 through 5 in that the turbulence device is composed of an inner member 27 and an outer member 28. The inner member 27 comprises a circular plate connected by a bar 14 to the cylinder head 2 and having a central orifice 5. The circular turbulence plate 27 has an outside diameter smaller than the inside diameter of the cylinder 3. The outer member 28 comprises an annular flange integral with and projecting from the inner peripheral wall of the cylinder 3. The annular flange 28 has an inside diameter smaller than the outside diameter of the circular turbulence plate 27. The circular turbulence plate 27 and the annular flange 28 are releasably engageable in response to reciprocating movement of the cylinder 3 relative to the cylinder head 2. They are disposed such that the circular turbulence plate 27 and the annular flange 28 are spaced from one another to thereby allow the combustion gases to flow through the orifice 15 and through a space between the turbulence plate and the annular flange 28 when the tool is in the standby and scavenging condition (FIG. 8), while the circular turbulence plate 27 and the annular flange 28 engage together to block the flow of combustion gases through a clearance therebetween when the tool is in the driving condition (FIG. 9).

Figure 10:
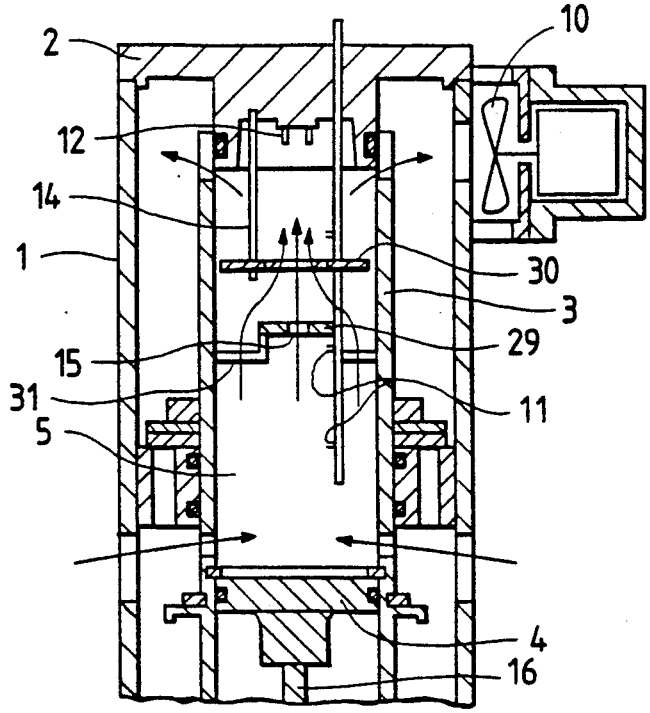
FIGS. 10 and 11 are views similar to FIGS. 8 and 9, respectively, showing a combustion gas powered fastener driving tool according to a fourth embodiment of this invention.
Figure 11:
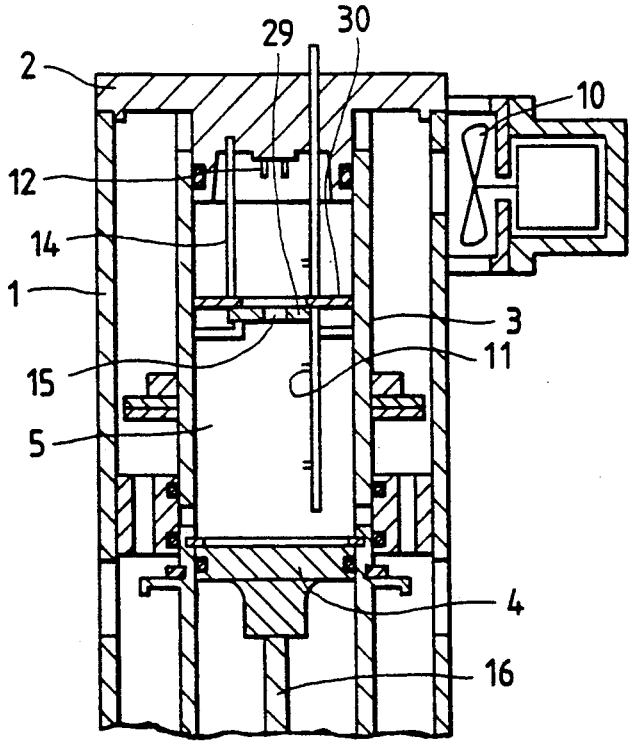

FIGS. 10 and 11 show a portion of a fastener driving tool according to a fourth embodiment of this invention. This fastener driving tool includes a two-piece turbulence device which is structurally and functionally identical to the turbulence device of the tool shown in FIGS. 8 and 9 except for the following features. The turbulence device is composed of an inner member 29 and an outer member 30 releasably engageable in response to reciprocating movement of the cylinder 3 relative to the cylinder head 2. The inner member 29 comprises a circular turbulence plate having a central orifice 15 and connected by support arms 31 to the cylinder 3. The circular turbulence plate 29 has an outside diameter smaller than the inside diameter of the cylinder 3. The outer member 30 comprises an annular disc connected by a bar 14 to the cylinder head 2 and having an outside diameter substantially the same as the inside diameter of the cylinder 3. The inside diameter of the annular disc 30 is smaller than the outside diameter of the circular turbulence plate 29

Figure 12:
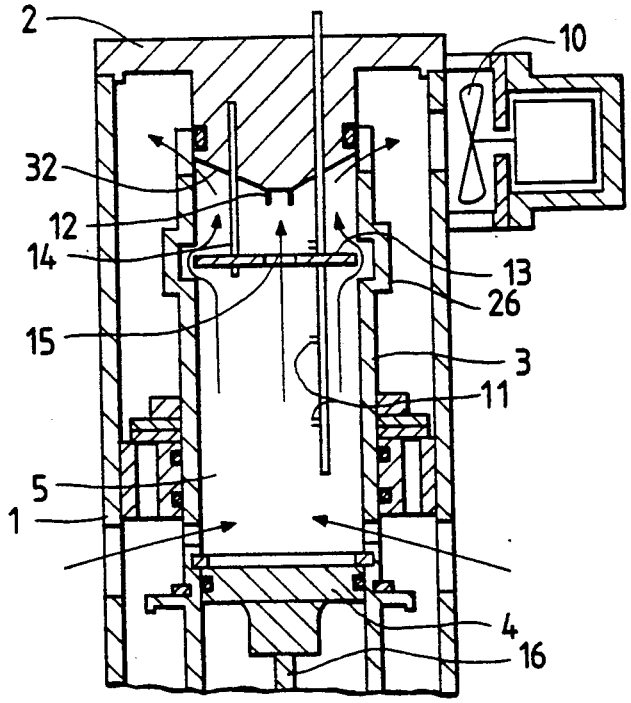
FIGS. 12 and 13 are fragmentary cross-sectional views of a combustion gas powered fastener driving tool in different states, respectively, according to a fifth embodiment of this invention.
Figure 13:
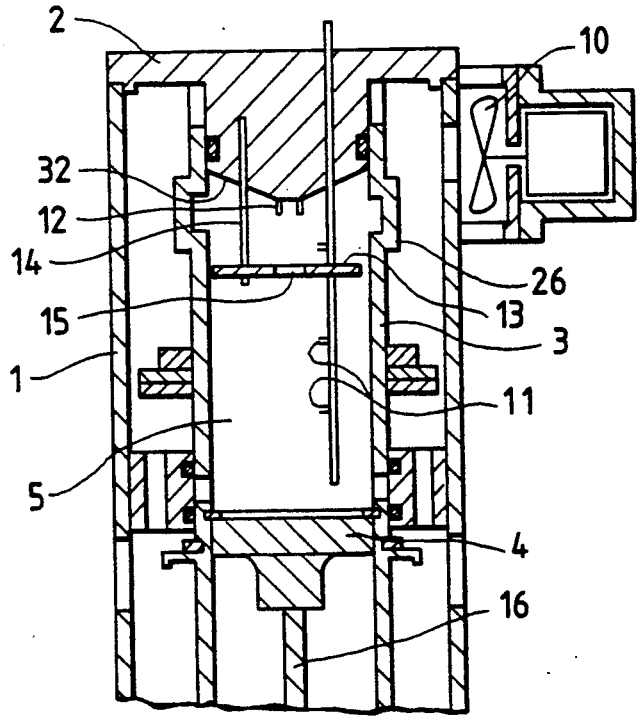

FIGS. 12 and 13 shows a portion of a combustion gas powered fastener driving tool according to a fifth embodiment of this invention. The fastener driving tool of this embodiment is similar to the tool of the embodiment shown in FIGS. 6 and 7 and differs therefrom in that the cylinder head 2 has a substantially conical inner surface 32 facing the combustion chamber 5 for guiding the combustion gases smoothly to the outside of the tool, thereby accelerating scavenging of the combustion chamber 5.

Figure 14:
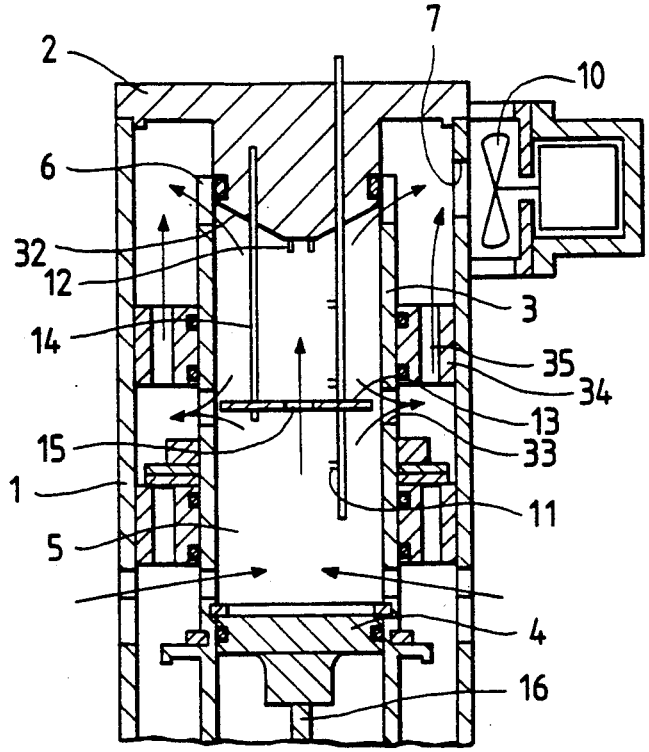
FIGS. 14 and 15 are views similar to FIGS. 12 and 13, respectively, showing a combustion gas powered fastener driving tool according to a sixth embodiment of this invention.
Figure 15:
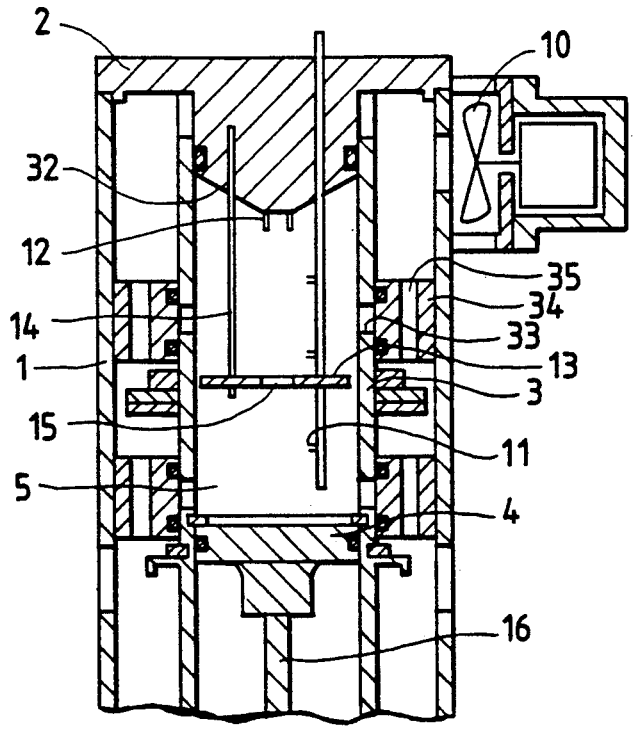

FIGS. 14 and 15 illustrate a portion of a fastener driving tool according to a sixth embodiment of this invention. The fastener driving tool of this embodiment is substantially identical to the tool of the embodiment shown in FIGS. 12 and 13 except for the following features. The cylinder 3 has peripheral holes 33 through which the combustion gases move when they are discharged from the combustion chamber 5. A second seal ring 34 is firmly fitted with the housing 1 and has connecting holes 35 extending axially therethrough. The peripheral holes 33 are selectively closed by the seal ring 34 in response to the reciprocating movement of the cylinder 3. When the cylinder 3 is displaced away from the cylinder head 2 during the standby and scavenging operation, the peripheral holes 33 are disposed in a same plane as the circular turbulence plate 13 and they are not closed by the seal ring 34, as shown in FIG. 14. In this instance, the combustion gases in the combustion chamber 5 are discharged not only through the upper openings and through the discharge hole 7 but also through the peripheral holes 33 and through the connecting holes 35. Conversely, when the cylinder 3 is displaced toward the cylinder head 2 during fastener driving operation, the peripheral holes 33 are closed by the seal ring 34 and they are upwardly displaced out of alignment with the plane of the circular turbulence plate 13.

Figure 16:
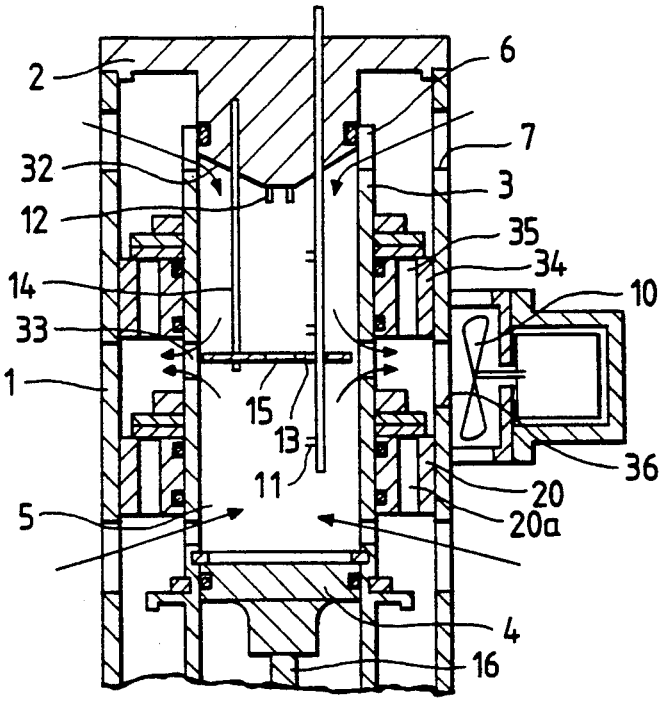
FIGS. 16 and 17 are fragmentary cross-sectional views of a combustion gas powered fastener driving tool in different states, respectively, according to a seventh embodiment of this invention.
Figure 17:
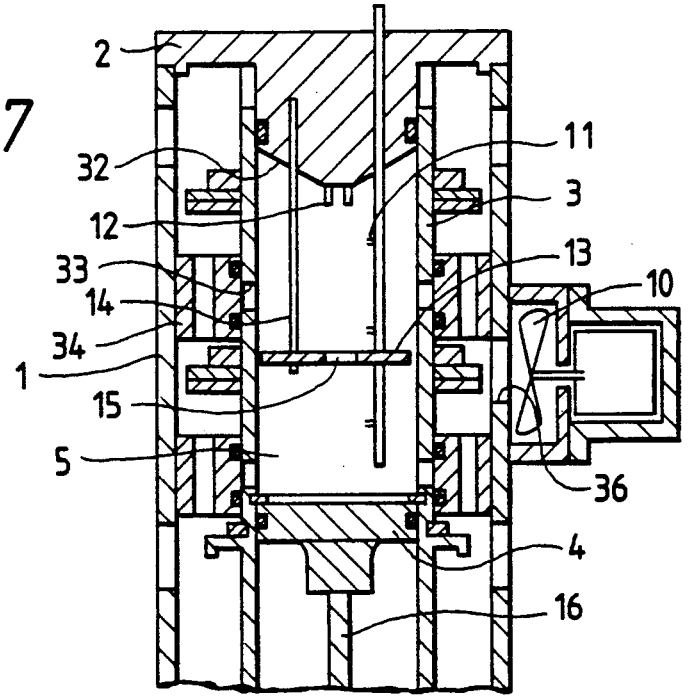

FIGS. 16 and 17 show a fastener driving tool according to a seventh embodiment of this invention. This tool differs from the tool of the embodiment shown in FIGS. 14 and 15 in that the electric fan 10 is disposed in a position to cause fresh air to be drawn from the upper and lower openings 6, 8 into the combustion chamber 5 and to move out from the combustion chamber 5 through the peripheral openings 33. More specifically, the electric fan 10 is disposed in front of a discharge hole 36 formed in the housing 1 between the first and second seal rings 20, 34. The first seal ring 20 also has connecting holes **20*a* extending axially therethrough. In this embodiment, the upper and lower openings 6, 8 serve as air inlet openings, while the peripheral openings 33** serve as air outlet openings.

Obviously various minor changes and modifications of the present invention are possible in the light of the above teaching. It is therefore to be understood that within the scope of the appended claims the invention may be practiced otherwise than as specifically described. When the fastener driving tool is in the operating or driving condition shown in FIG. 17, fresh air is drawn by the electric fan 10 from the air inlet openings 9 (see FIG. 2) into an annular space between the cylinder 3 and the housing 1, then flows upwardly through the connecting holes **20*a* and is finally discharged from the discharge hole 36, so that the cylinder 3 is cooled by the fresh air at a portion located near the top dead center of the piston 4**.

What is claimed is:

1. A combustion gas powered fastener driving tool comprising:

a cylinder:

a cylinder head sealingly engageable with an upper end of said cylinder;

a piston slidably disposed within said cylinder and reciprocatingly movable between an uppermost driving position and a lowermost driven position, said cylinder, said cylinder head and said piston defining a combustion chamber;

a fastener driver attached to said piston;

at least one fuel injection nozzle disposed within said combustion chamber for injecting fuel into said combustion chamber where the fuel and air are mixed together;

a spark plug mounted on said cylinder head and disposed within the combustion chamber for igniting a fuel and air mixture to move said piston through a driving stroke from said driving position to said driven position, thereby forcing the fastener driver to drive a fastener into a workpiece;

said cylinder having inlet and outlet openings and being reciprocatingly movable toward and away from said cylinder head to close off said inlet and outlet openings to seal said combustion chamber during combustion and open said inlet and outlet openings to permit scavenging of said combustion chamber and return of said piston after the driving stroke of said piston, said inlet and outlet openings being disposed above said piston when the piston is disposed in its uppermost driving position; and a fan disposed outside said cylinder for causing fresh air to flow from said inlet opening into the combustion chamber and simultaneously to discharge combustion gases from said combustion chamber to the atmosphere through said outlet opening.

2. A combustion gas powered fastener driving tool according to claim 1, further including a tubular housing connected at an upper end to said cylinder head and extending coaxially with said cylinder, said cylinder being received in said housing, wherein said fan is mounted to said housing.

3. A combustion gas powered fastener driving tool according to claim 1, further including means in said combustion chamber for causing turbulence in said combustion chamber.

4. A combustion gas powered fastener driving tool according to claim 3, wherein said turbulence causing means comprises a circular turbulence plate mounted to the cylinder head to be supported with the combustion chamber and having a central orifice, said circular turbulence plate having an outside diameter substantially the same as the inside diameter of said cylinder.

5. A combustion gas powered fastener driving tool, comprising:

a cylinder;

a cylinder head sealingly engageable with an upper end of said cylinder;

a piston slidably disposed within said cylinder and reciprocatingly movable between an uppermost driving position and a lowermost driven position, said cylinder, said cylinder head and said piston defining a combustion chamber;

a fastener driver attached to said piston;

at least one fuel injection nozzle disposed within said combustion chamber for injecting fuel into said combustion chamber where the fuel and air are mixed together;

a spark plug mounted on said cylinder head and disposed within the combustion chamber for igniting a fuel and air mixture to move said piston through a driving stroke from said driving position to said driven position, thereby forcing the fastener driver to drive a fastener into a workpiece;

said cylinder having inlet and outlet openings and being reciprocatingly movable toward and away from said cylinder head to close off said inlet and outlet openings to seal said combustion chamber during combustion and open said inlet and outlet opening to permit scavenging of said combustion chamber and return of said piston after the driving stroke of said piston, said inlet and outlet openings being disposed above said piston when the piston is disposed in its uppermost driving position;

a fan disposed outside said cylinder for causing fresh air to flow from said inlet opening into the combustion chamber and simultaneously to discharge combustion gases from said combustion chamber to the atmosphere through said discharge opening; and means for reciprocating said cylinder relative to said cylinder head in timed relation to the driving stroke of said piston.

6. A combustion gas powered fastener driving tool according to claim 5, wherein said reciprocating means includes a ring member slidably fitted over said cylinder, a guide extending from an end of said ring member for engagement with the workpiece before and during the driving stroke of said piston, first spring means for urging said ring member away from said cylinder head, second spring means acting between said cylinder and said ring member for urging them away from one another, a pressure chamber defined between said cylinder and said ring member, and a communicating hole defined in said cylinder for connecting said combustion chamber and said pressure chamber when the piston is disposed in its lowermost driven position.

7. A combustion gas powered fastener driving tool, comprising:

a cylinder;

a cylinder head sealingly engageable with an upper end of said cylinder;

a piston slidably disposed within said cylinder and reciprocatingly movable between an uppermost driving position and a lowermost driven position, said cylinder, said cylinder head and said piston defining a combustion chamber;

a fastener driver attached to said piston;

at least one fuel injection nozzle disposed within said combustion chamber for injecting fuel into said combustion chamber where the fuel and air are mixed together;

a spark plug mounted on said cylinder head and disposed within the combustion chamber for igniting a fuel and air mixture to move said piston through a driving stroke from said driving position to said driven position, thereby forcing the fastener driver to drive a fastener into a workpiece;

said cylinder having inlet and outlet openings and being reciprocatingly movable toward and away from said cylinder head to close off said inlet and outlet openings to seal said combustion chamber during combustion and open said inlet and outlet openings to permit scavenging of said combustion chamber and return of said piston after the driving stroke of said piston, said inlet and outlet openings being disposed above said piston when the piston is disposed in its uppermost driving position;

a fan disposed outside said cylinder for causing fresh air to flow form said inlet opening into the combustion chamber and simultaneously to discharge combustion gases from said combustion chamber to the atmosphere through said discharge opening;

a tubular housing connected at an upper end to said cylinder head and extending coaxially with said cylinder, said cylinder being received in said housing, said fan is mounted on said housing; and a ring firmly fitted within said housing for closing said inlet opening when said cylinder is displaced toward said cylinder head.

8. A combustion gas powered fastener driving tool, comprising:

a cylinder;

a cylinder head sealingly engageable with an upper end of said cylinder;

a piston slidably disposed within said cylinder and reciprocatingly movable between an uppermost driving position and a lowermost driven position, said cylinder, said cylinder head and said piston defining a combustion chamber;

a fastener driver attached to said piston;

at least one fuel injection nozzle disposed within said combustion chamber for injecting fuel into said combustion chamber where the fuel and air are mixed together;

a spark plug mounted on said cylinder head and disposed within the combustion chamber for igniting a fuel and air mixture to move said piston through a driving stroke from said driving position to said driven position, thereby forcing the fastener driver to drive a fastener into a workpiece;

said cylinder having inlet and outlet openings and being reciprocatingly movable toward and away from said cylinder head to close off said inlet and outlet openings to seal said combustion chamber during combustion and open said inlet and outlet openings to permit scavenging of said combustion chamber and return of said piston after the driving stroke of said piston, said inlet and outlet openings being disposed above said piston when the piston is disposed in its uppermost driving position;

a fan disposed outside cylinder for causing fresh air to flow from said inlet opening into the combustion chamber and simultaneously to discharge combustion gases from said combustion chamber to the atmosphere through said discharge opening, and means in said combustion chamber for causing turbulence in said combustion chamber, wherein said turbulence causing means comprises a circular turbulence plate mounted to the cylinder head to be supported within the combustion chamber and having a central orifice, said circular turbulence plate having an outside diameter substantially the same as the inside diameter of said cylinder, and wherein said cylinder head has a substantially conical inside surface facing said combustion chamber.

9. A combustion gas powered fastener driving tool, comprising:

a cylinder;

a cylinder head sealingly engageable with an upper end of said cylinder;

a piston slidably disposed within said cylinder and reciprocatingly movable between an uppermost driving position and a lowermost driven position, said cylinder, said cylinder head and said piston defining a combustion chamber;

a fastener driver attached to said piston;

at least one fuel injection nozzle disposed within said combustion chamber for injecting fuel into said combustion chamber where the fuel and air are mixed together;

a spark plug mounted on said cylinder head and disposed within the combustion chamber for igniting a fuel and air mixture to move said piston through a driving stroke from said driving position to said driven position, thereby forcing the fastener driver to drive a fastener into a workpiece;

said cylinder having inlet and outlet openings and being reciprocatingly movable toward and away from said cylinder head to close off said inlet and outlet openings to seal said combustion chamber during combustion and open said inlet and outlet openings to permit scavenging of said combustion chamber and return of said piston after the driving stroke of said piston, said inlet and outlet openings being disposed above said piston when the piston is disposed in its uppermost driving position;

a fan disposed outside said cylinder for causing fresh air to flow from said inlet opening into the combustion chamber and simultaneously to discharge combustion gases from said combustion chamber to the atmosphere through said discharge opening, said means in said combustion chamber for causing turbulence in said combustion chamber, wherein said turbulence causing means comprises a circular turbulence plate mounted to the cylinder head to be supported within the combustion chamber and having a central orifice, said circular turbulence plate having an outside diameter substantially the same as the inside diameter of said cylinder, and means cooperative with said circular turbulence plate for promoting scavenging of said combustion chamber.

10. A combustion gas powered fastener driving tool according to claim 9, wherein said scavenging promoting means comprises a bulged circumferential portion of said cylinder said bulged portion extending in a same plane as said circular turbulence plate when said fastener tool is in a standby and scavenging condition, said bulged portion and said circular turbulence plate extending in different planes when said fastener driving tool is in an operating or driving condition.

11. A combustion gas powered fastener driving tool according to claim 10, wherein said cylinder head has a substantially conical inside surface facing said combustion chamber.

12. A combustion gas powered fastener driving tool, comprising:

a cylinder;

a cylinder head sealingly engageable with an upper end of said cylinder;

a piston slidably disposed within said cylinder and reciprocatingly movable between an uppermost driving position and a lowermost driven position, said cylinder, said cylinder head and said piston defining a combustion chamber;

a fastener driver attached to said piston;

at least one fuel injection nozzle disposed within said combustion chamber for injecting fuel into said combustion chamber where the fuel and air are mixed together;

a spark plug mounted on said cylinder head and disposed within the combustion chamber for igniting a fuel and air mixture to move said piston through a driving stroke from said driving position to said driven position, thereby forcing the fastener driver to drive a fastener into a workpiece;

said cylinder having inlet and outlet openings and being reciprocatingly movable toward and away from said cylinder head to close off said inlet and outlet openings to seal said combustion chamber during combustion and open said inlet and outlet openings to permit scavenging of said combustion chamber and return of said piston after the driving stroke of said piston, said inlet and outlet openings being disposed above said piston when the piston is disposed in its uppermost driving position;

a fan disposed outside said cylinder for causing fresh air to flow from said inlet opening into the combustion chamber and simultaneously to discharge combustion gases from said combustion chamber to the atmosphere through said discharge opening; and means in said combustion chamber for causing turbulence in said combustion chamber, wherein said turbulence causing means comprises an inner member connected to said cylinder head and an outer member integral with said cylinder, said inner and outer members being held in contact with each other during combustion and being separated apart after the driving stroke of said piston.

13. A combustion gas powered fastener driving tool according to claim 12, wherein said inner member comprises a circular turbulence plate having a central orifice and also having an outside diameter smaller than the inside diameter of said cylinder, said outer member comprising an annular flange projecting from an inner peripheral wall of said cylinder, said annular flange having an inside diameter smaller than said outside diameter of said circular turbulence plate.

14. A combustion gas powered fastener driving tool, comprising a cylinder;

a cylinder head sealingly engageable with an upper end of said cylinder;

a piston slidably disposed within said cylinder and reciprocatingly movable between an uppermost driving position and a lowermost driven position, said cylinder, said cylinder head and said piston defining a combustion chamber;

a fastener driver attached to said piston;

at least one fuel injection nozzle disposed within said combustion chamber for injecting fuel into said combustion chamber where the fuel and air are mixed together;

a spark plug mounted on said cylinder head and disposed within the combustion chamber for igniting a fuel and air mixture to move said piston through a driving stroke forms aid driving position to said driven position, thereby forcing the fastener driver to drive a fastener into a workpiece;

said cylinder having inlet and outlet openings and being reciprocatingly movable toward and away from said cylinder head to close off said inlet and outlet openings to seal said combustion chamber during combustion and open said inlet and outlet openings to permit scavenging of said combustion chamber and return of said piston after the driving stroke of said piston, said inlet and outlet openings being disposed above said piston when the piston is disposed in its uppermost driving position;

a fan disposed outside said cylinder for causing fresh air to flow from said inlet opening into the combustion chamber and simultaneously to discharge combustion gases from said combustion chamber to the atmosphere through said discharge opening; and means in said combustion chamber for causing turbulence in said combustion chamber, wherein said turbulence causing means comprises an inner member connected to said cylinder and an outer member connected to said cylinder head, said inner and outer members being held in contact with each other during combustion and being separated apart after the driving stroke of said piston.

15. A combustion gas powered fastener driving tool according to claim 14, wherein said inner member comprises a circular turbulence plate having a central orifice and also having an outside diameter smaller than the inside diameter of said cylinder, said outer member comprising an annular disc having an inside diameter smaller than said outside diameter of said circular turbulence plate.

16. A combustion gas powered fastener driving tool, comprising:

a cylinder;

a cylinder head sealingly engageable with an upper end of said cylinder;

a piston slidably disposed within said cylinder and reciprocatingly movable between an uppermost driving position and a lowermost driven position, said cylinder, said cylinder head and said piston defining a combustion chamber;

a fastener driver attached to said piston;

at least one fuel injection nozzle disposed within said combustion chamber for injecting fuel into said combustion chamber where the fuel and air are mixed together;

a spark plug mounted on said cylinder head and disposed within the combustion chamber for igniting a fuel and air mixture to move said piston through a driving stroke form said driving position to said driven position, thereby forcing the fastener driver to drive a fastener into a workpiece;

said cylinder having inlet and outlet openings and being reciprocatingly movable toward and away from said cylinder head to close off said inlet and outlet openings to seal said combustion chamber during combustion and open said inlet and outlet openings to permit scavenging of said combustion chamber and return of said piston after the driving stroke of said piston, said inlet and outlet openings being disposed above said piston when the piston is disposed in its uppermost driving position;

a fan outside said cylinder for causing fresh air to flow from said inlet opening into the combustion chamber and simultaneously to discharge combustion gases from said combustion chamber to the atmosphere through said discharge opening; and a circular turbulence place mounted to the cylinder head to be supported within said combustion chamber and having a central orifice, said circular turbulence plate having an outside diameter substantially the same as the inside diameter of said cylinder, the number of said inlet openings being two and disposed on opposite sides of said outlet opening in a longitudinal direction of said cylinder, further including a stationary seal ring disposed around said cylinder for closing said outlet opening during combustion and opening said outlet opening after the driving stroke of said piston.

17. A combustion gas powered fastener driving tool, comprising:

a cylinder;

a cylinder head sealingly engageable with an upper end of said cylinder;

a piston slidably disposed within said cylinder and reciprocatingly movable between an uppermost driving position and a lowermost driven position, said cylinder, said cylinder head and said piston defining a combustion chamber;

a fastener driver attached to said piston;

at least one fuel injection nozzle disposed within said combustion chamber for injecting fuel into said combustion chamber where the fuel and air are mixed together;

a spark plug mounted on said cylinder head and disposed within the combustion chamber for igniting a fuel and air mixture to move said piston through a driving stroke from said driving position to said driven position, thereby forcing the fastener driver to drive a fastener into a workpiece;

said cylinder having inlet and outlet openings and being reciprocatingly movable toward and away from said cylinder head to close off said inlet and outlet openings to seal said combustion chamber during combustion and open said inlet and outlet openings to permit scavenging of said combustion chamber and return of said piston after the driving stroke of said piston, said inlet and outlet openings being disposed above said piston when the piston is disposed in its uppermost driving position; and a fan disposed outside said cylinder for causing fresh air to flow from said inlet opening into the combustion chamber and simultaneously to discharge combustion gases from said combustion chamber to the atmosphere through said discharge opening, wherein said cylinder head has a substantially conical inside surface facing said combustion chamber.

* * * * *